US011780713B2

(12) United States Patent
Kaiturinmäki

(10) Patent No.: US 11,780,713 B2
(45) Date of Patent: Oct. 10, 2023

(54) ROPE GUIDING DEVICE AND A METHOD FOR GUIDING A ROPE

(71) Applicant: KONECRANES GLOBAL CORPORATION, Hyvinkää (FI)

(72) Inventor: Jari Kaiturinmäki, Hyvin kää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 837 days.

(21) Appl. No.: 16/640,395

(22) PCT Filed: Aug. 21, 2018

(86) PCT No.: PCT/FI2018/050593

§ 371 (c)(1),
(2) Date: Feb. 20, 2020

(87) PCT Pub. No.: WO2019/038475

PCT Pub. Date: Feb. 28, 2019

(65) Prior Publication Data

US 2020/0354202 A1 Nov. 12, 2020

(30) Foreign Application Priority Data

Aug. 21, 2017 (FI) ..... 20175743

(51) Int. Cl.
*B66D 1/38* (2006.01)
*B66D 1/48* (2006.01)

(52) U.S. Cl.
CPC ..... *B66D 1/38* (2013.01); *B66D 1/485* (2013.01)

(58) Field of Classification Search
CPC ..... B66D 1/38; B66D 1/485
See application file for complete search history.

(56) References Cited

U.S. PATENT DOCUMENTS

| | | | |
|---|---|---|---|
| 2,660,382 | A | 11/1953 | Wilson |
| 3,226,090 | A | 12/1965 | Sauerbrey |
| 3,951,355 | A | 4/1976 | Morioka et al. |
| 5,829,737 | A | 11/1998 | Gersemsky |

(Continued)

FOREIGN PATENT DOCUMENTS

| | | | |
|---|---|---|---|
| DE | 42 41 655 | C1 | 4/1994 |
| DE | 102012013527 | A1 | 1/2014 |
| EP | 2 921 448 | A1 | 9/2015 |

(Continued)

OTHER PUBLICATIONS

International Preliminary Report on Patentability, issued in PCT/FI2018/050593, dated Jan. 20, 2020.

(Continued)

*Primary Examiner* — Sang K Kim
(74) *Attorney, Agent, or Firm* — Birch, Stewart, Kolasch & Birch, LLP

(57) ABSTRACT

A rope guiding device for guiding a rope on a rope drum, the rope drum being adaptable to rotate about a drum axis to wind the rope around the rope drum or from the rope drum to hoist and lower a load adapted on the rope, includes at least guiding element, and an actuator for generating a rope guiding force, which force affects each guiding element in the direction of the drum axis so that the movement of each guiding element in the direction of the drum axis may be guided by the force.

13 Claims, 5 Drawing Sheets

(56) References Cited

U.S. PATENT DOCUMENTS 6,443,431 B1 * 9/2002 Stasny ..... B66D 1/38
254/335
6,811,112 B1 * 11/2004 Currie ..... B65H 54/2872
242/548.1

FOREIGN PATENT DOCUMENTS

| | | | |
|---|---|---|---|
| FR | 1006645 | A | 4/1952 |
| GB | 543323 | | 2/1942 |
| GB | 1 393 193 | | 5/1975 |
| JP | 62-244896 | A | 10/1987 |
| JP | 1-242396 | A | 9/1989 |

OTHER PUBLICATIONS

International Search Report, issued in PCT/FI2018/050593, dated Nov. 22, 2018.
Written Opinion of the International Preliminary Examining Authority, issued in PCT/FI2018/050593, dated Nov. 12, 2019.
Written Opinion of the International Searching Authority, issued in PCT/FI2018/050593, dated Nov. 22, 2018.
Extended European Search Report, dated May 21, 2021 for European Application No. 18648492.7.

* cited by examiner

ROPE GUIDING DEVICE AND A METHOD FOR GUIDING A ROPE

BACKGROUND

The invention relates to ropings of hoisting devices and, in particular, to a rope guiding device and method for guiding a rope in connection with hoisting devices.

The rope angle range available in ropings of hoisting device as far as the rope angles of a rope disengaging from a rope drum is very limited, because with angles larger than four angles the staying of the rope on the rope drum as well as the wear on brushes, drum and rope begin to impede the use of the hoisting device and shorten the service life of its parts, which is referred to in the standard EN 13001-3-2, for example.

From publication U.S. Pat. No. 5,829,737 a solution is known for guiding such a rope unwound from and wound onto the rope drum of a hoisting device in order to soften the rope movement in particular when the rope is subjected to lateral and diagonal forces. Such a guiding device is, however, only suitable for use with the aforementioned less than four degree rope angles, which limits the options for the roping and, for example, the number of rope pulleys used in the roping as well as available diameter relation of the rope drum and rope.

BRIEF DISCLOSURE

It is thus an object of the invention to provide a novel method and a rope guiding device suited to implementing the method. The object of the invention is achieved by a method and rope guiding device that are characterised by what is stated in the independent claims. Preferred embodiments are also disclosed in the dependent claims.

The invention is based on guiding a rope unwound from the rope drum with the rope guiding device which, with a force parallel to the drum axis of the rope drum, compensates the rope angle which is caused by the angle between rope run-off point from the rope drum and the subsequent guiding structure closest to the rope drum and guiding the direction of the rope, such as the rope pulley which is the first one as seen from the rope drum.

The advantage of the method and rope guiding device of the invention is that the rope angle no longer limits the planning of the hoisting device geometry, the number of rope pulleys in the roping, or the ratio between the rope drum and the rope, which allows the size of the components of the hoisting device to be made smaller, due to the torque the rope drum is subjected to becoming smaller.

BRIEF DESCRIPTION OF THE FIGURES

The invention will now be described in more detail in connection with preferred embodiments and with reference to the accompanying drawings, in which.

DETAILED DESCRIPTION OF THE INVENTION

The rope guiding device now disclosed may be used in connection with a hoisting device, in particular in connection the rope drum of the hoisting device. Such a rope drum may also be referred to as a rope reel or a winding drum. The rope guiding device now disclosed may be used to implement the method for guiding a rope now disclosed, whereby the rope guiding device or part of it may on the other hand be adapted to implement different phases of the method.

Figure 1:
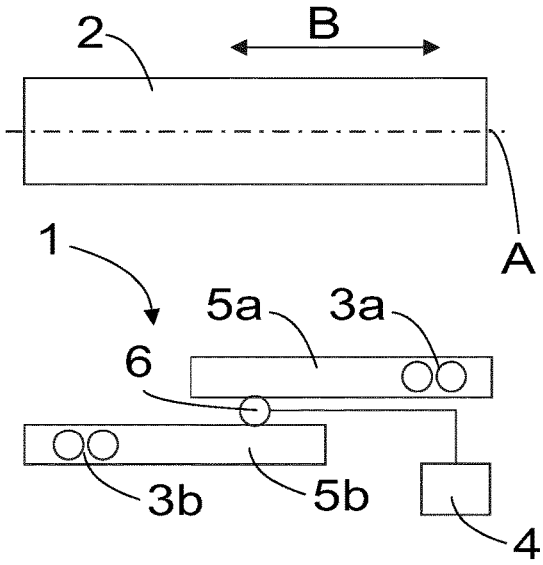
FIG. 1 is a schematic view of a rope guiding device according to an embodiment.
Figure 2:
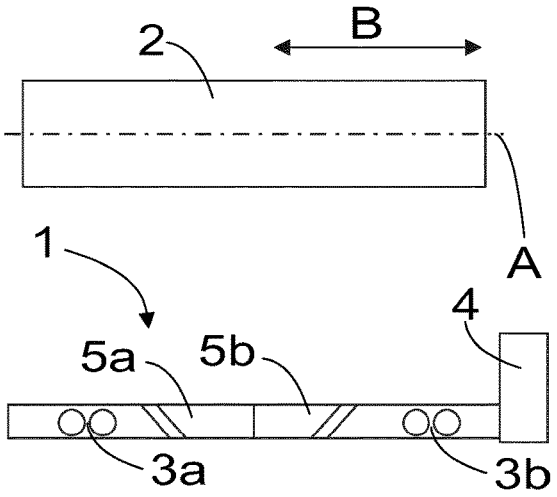
FIG. 2 is a schematic view of a rope guiding device according to a second embodiment.
Figure 3:
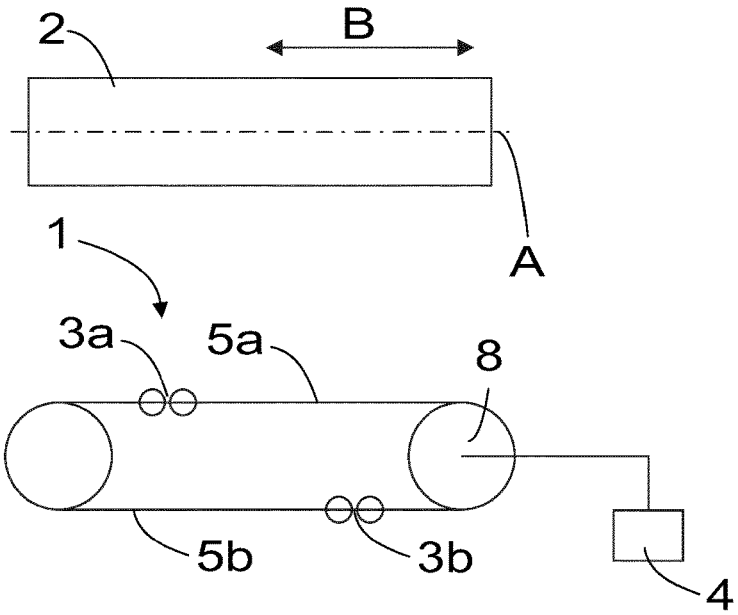
FIG. 3 is a schematic view of a rope guiding device according to a third embodiment.
Figure 4:
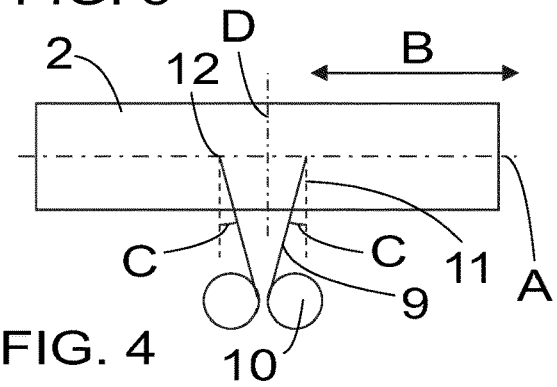
FIG. 4 shows schematically a rope drum and rope angle.
Figure 7:
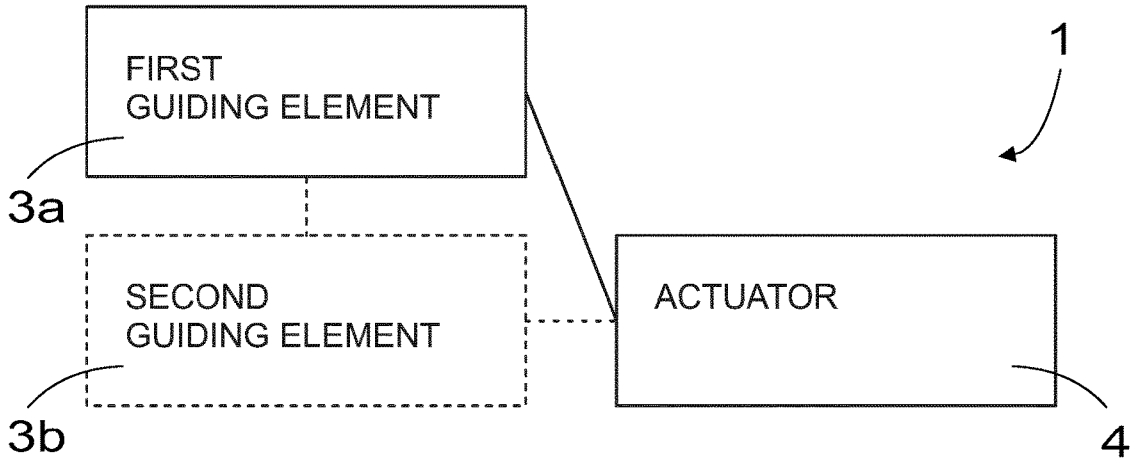
FIG. 7 is a schematic view of a rope guiding device.

FIG. 7 shows schematically such a rope guiding device 1 for guiding a rope on a rope drum 2. FIGS. 1 to 3 show schematically embodiments of such a rope guiding device 1 and FIG. 4 shows schematically the rope drum 2 and rope angle C.

The rope drum 2 may be adapted to rotate about the drum axis A to wind the rope 9 around the rope drum or from the rope drum to hoist and lower a load (not shown) adapted on the rope. Such rope drums may be grooved or non-grooved and are as such known, so the features of a rope drum are not for that reason described in any closer detail here.

The rope guiding device 1 comprises at least guiding element 3*a*, 3*b*. Guiding element 3*a*, 3*b* refers to a structure through the structures or parts thereof, or between which, the rope 9 is guided to restrict the movement, such as lateral movement, of the rope, and/or to change the direction of the rope. Drum axis A in this context refers to the longitudinal axis of the rope drum, which is also the rotating axle of the rope drum 2, and direction B of the drum axis, the direction parallel to the drum axis.

The rope guiding device 1 in an embodiment comprises at least two guiding element 3*a*, 3*b*. The guiding elements 3*a*, 3*b* may be adapted to move in relation to each other in the direction B of the drum axis at the same time and at the same speed. Depending on the embodiment, the guiding elements 3*a*, 3*b* may be adapted to move in relation to each other in the same direction or opposite directions.

The rope guiding device 1 further comprises an actuator 4 for generating a rope guiding force E. For reasons of clarity, this document refers to the rope guiding force E with just the expression force E when it is obvious from the context that no other force is referred to. This force E affects each guiding element 3*a*, 3*b* in the direction B of the drum axis so that the movement of each guiding element in the direction B of the drum axis may be guided by means of the force E. To be more exact, the rope guiding force E makes it possible to guide each guiding element 3*a*, 3*b* of the rope guiding device to the desired position in the direction B of the drum axis regardless of the force, in the direction of the drum axis, potentially directed by the rope 9 onto the guiding element 3*a*, 3*b* and resisting it. The position of the guiding elements 3*a*, 3*b* is such a case refers to the location of the guiding elements 3*a*, 3*b* in relation to the rope drum 2, in particular the location in the direction B of the drum axis. It should be noted that the rope guiding force E created by the actuator 4 and the forces that the rope 9 applies to the guiding element 3*a*, 3*b* may also comprise components in another direction than the force affecting in the direction B of the drum axis. As regards the torque formed by the actuator 4 it is however advantageous to minimize the components in other directions, so the forming of force in substantially the direction of the drum axis A, to optimize power usage.

FIG. 4 shows schematically a rope drum 2 and rope angle. Rope angle refers to the fleet angle C of the rope from the rope drum 2 to the direction of the radius 11 of the rope drum, compared to the direction B of the drum axis, as shown in FIG. 4. To be more specific, the fleet angle C of the rope 9 refers to the angle that corresponds to the plane of the circumference of the rope drum 2 passing through the rope drum run-off point 12.

Without the rope guiding device 1 now disclosed, the situation correspond to the situation in FIG. 4, where the rope 9 exits the rope drum 2 at a fleet angle C determined by the angle between the rope drum run-off point 12 from the rope drum of the rope 9 and the closest guiding structure 10, such as a rope pulley, following the rope drum and guiding the direction of the rope. By means of the presented rope guiding device 1, it is possible to affect the fleet angle C by means of the rope guiding force E formed by the actuator 4.

In an embodiment, the actuator 4 may be adapted to guide each guiding element 3*a*, 3*b* to such a position that the fleet angle C of the rope from the rope drum is less than 4 degrees in relation to the direction of the radius 11 of the rope drum, regardless of the angle between the rope run-off point 12 from the rope drum and the closest subsequent guiding structure 10 following the rope drum and guiding the direction of the rope. The advantage of such an embodiment is that the restrictions set by the rope angle on the roping geometry and dimensioning of the rope drum and rope may be got rid of. In an embodiment, the actuator 4 may be adapted to guide each guiding element 3*a*, 3*b* to such a position that the rope fleet angle C from the rope drum is substantially in the direction of the radius 11 of the rope drum, so the fleet angle C in relation to the direction of the radius 11 of the rope drum is 0 degrees or approximately 0 degrees, regardless of the angle between the rope run-off point 12 from the rope drum and the closest subsequent guiding structure 10 following the rope drum and guiding the direction of the rope. Naturally, this solution is even more advantageous from the point of view of the freedom to design the roping and rope drum.

In an embodiment, the guiding elements 3*a*, 3*b* may have been adapted in relation to the rope drum 2 so that the guiding elements move mutually at the same pace in at least the direction B of the drum axis. In other words, the guiding elements 3*a*, 3*b* may be adapted to move mutually at the same time and same speed either in the same direction or opposite directions depending on the embodiment, such as the roping of the rope drum 2. In such a case in the embodiment of FIG. 4, for example, the guiding element 3*a*, 3*b* may be adapted to set in each of its positions at a mutually same distance, in particular at a distance in the direction B of the drum axis, from the centre point D of the rope drum 2, on the length of which rope has been wound around the rope drum. In other words, in an embodiment the guiding elements 3*a*, 3*b* may be in each position adapted symmetrically in relation to the centre point D of the rope-covered area of the rope drum 2 at least in the direction B of the drum axis, whereby the rope guiding device 1 may guide two ropes at any one time at a same distance from the centre point D. On the other hand, in a second embodiment, in which two ropes 9 are adapted on the rope drum 2 wound in the same direction, so for example wound from right to left or left to right, the mutual distance between the guiding elements 3*a*, 3*b* may in each position of the guiding elements 3*a*, 3*b* remain substantially the same.

In an embodiment, the rope guiding device 1 which comprises a first movement member 5*a* extending in the direction of the drum axis A, to which the first or said two guiding elements, also referred to as the first guiding element 3*a*, is immovably adapted, and a second movement member 5*b* extending in the direction of the drum axis A, to which the second or said two guiding elements, also referred to as the second guiding element 3*b*, is immovably adapted The first movement member 5*a* and the second movement member 5*b* may be coupled to each other so that the actuator 4 simultaneously acts on the first movement member 5*a* and the second movement member 5*b*. The first movement member 5*a* and the second movement member 5*b* may be coupled to each other directly or by means of one or more other structural parts. The first movement member 5*a* may be adapted to convey the rope guiding force E created by the actuator 4 to the first guiding element 3*a* and the second movement member 5*b* may be adapted to convey the rope guiding force E created by the actuator to the second guiding element 5*a*. Embodiments of such a rope guiding device 1 are shown in FIGS. 1 to 3.

In an embodiment, each movement member may comprise a toothed bar, screw, belt, or similar structure to transfer force in particular in the direction B of the drum axis.

The rope guiding device 1 in an embodiment may comprise one guiding element 3*a*, 3*b*, two guiding elements 3*a*, 3*b*, or more than two guiding elements. Correspondingly, the rope guiding device 1 may comprise one, two, or more movement members 5*a*, 5*b*. One or more guiding elements 3*a*, 3*b* may be adapted in each movement member 5*a*, 5*b*.

In an embodiment, each movement member 5*a*, 5*b* may comprise a toothed bar. In this case, the actuator 4 may be adapted to move each movement member 5*a*, 5*b* by means of a geared axle 6 to direct the rope guiding force to at least one guiding element 3*a*, 3*b* adapted in each movement member 5*a*, 5*b*. FIG. 1 is a schematic view of a rope guiding device 1 according to an embodiment. In the rope guiding device 1 of FIG. 1, the first movement member 5*a* may comprise a first toothed bar and the second movement member 5*b* may comprise a second toothed bar. The first and second toothed bar may be intercoupled by means of the geared axle 6. The toothing of the geared axle 6 may be adapted to couple to both the toothing of the first toothed bar and the second toothed bar so that the toothed bars move, as the geared axle 6 is rotated, simultaneously to opposite directions in the direction B of the drum axis. The rotation of the geared axle 6 may be implemented with the actuator 4, which may be adapted to rotate the geared axle 6. Such toothed bar-geared axle transmissions are known per se and are therefore not described in greater detail herein.

FIG. 2 is a schematic view of a rope guiding device 1 according to a second embodiment; Each movement member 5*a*, 5*b* may comprise a screw and the actuator 4 may be adapted to move each screw to direct the rope guiding force to at least one guiding element 3*a*, 3*b* adapted in each movement member 5*a*, 5*b*. In the rope guiding device 1 of FIG. 2, the first movement member 5*a* may comprise a right-handed screw and the second movement member 5*b* may comprise a left-handed screw. The right-handed screw and left-handed screw may be coupled to each other at their ends. The actuator 4 may be adapted to rotate the interconnected screws so that the guiding elements 3*a*, 3*b* adapted in said screws move, as the screws are rotated, simultaneously to opposite directions in the direction of the drum axis A. Screw in this context refers to a ball-race screw, conic screw, or similar movement member having the geometry of a screw. Such screw transmissions, such as ball-race screws, conic screws and similar solutions are known per se and are not for that reason described in any greater detail here.

FIG. 3 is a schematic view of a rope guiding device 1 according to a third embodiment; Each movement member 5*a*, 5*b* may comprise a belt or a part oft a belt, and the actuator 4 may be adapted to rotate the belt to direct the rope guiding force to at least one guiding element 3*a*, 3*b* adapted in each movement member 5*a*, 5*b*. In the rope guiding device 1 of FIG. 3, the actuator 4 may be adapted to rotate a drive wheel 8. In such a case, the first movement member 5*a* and second movement member 5*b* may form the belt so that the first guiding element 3*a* and the second guiding element 3*b* are adapted on different sides of the drive wheel 8. The actuator 4 may be adapted to rotate the belt by means of the drive wheel 8 so that the first guiding element 3*a* and the second guiding element 3*b* move simultaneously in different directions in the direction B of the drum axis. The belt may comprise a toothed belt, V-belt or another belt allowing form-locking and being suitable for the transmission of force, or a belt-like movement member of a similar type.

In an embodiment, the actuator 4 of the rope guiding device 1 may comprise a gear motor. The gear motor may in such a case be adapted to establish the rope guiding force E acting on the first guiding element 3*a* and the second guiding element 3*b*. Such an embodiment may be advantageous when, for example, precise and flexible guiding of the rope force is important. In a second embodiment, the actuator 4 may comprise a rope drum 2. In this case, each movement member 5*a*, 5*b* may be mechanically coupled, such as coupled by means of a suitable transmission, for example, gearing, gear transmission, or belt transmission, to the rope drum 2, whereby the rope guiding force may be formed on each guiding element 3*a*, 3*b* by driving the rope drum 2. Such a embodiment may be advantageous when, for example, it is desired to minimize the quantity of required components. It is naturally also possible to use other suitable actuators for the generation of the guiding force depending on the embodiment.

The actuator 4 may be adapted to rotate the geared axle 6, in the embodiment of FIG. 2 the actuator 4 may be adapted to rotate screws and in the embodiment of FIG. 3 the actuator 4 may be adapted to rotate the drive wheel 8.

In an embodiment, the rope guiding device 1 may be adapted to guide the rope 9 also when the rope is being wound on the rope drum 2. In other words, the rope guiding device 1 may be used to guide the rope both when unwinding the rope 9 from the rope drum 2 and when winding the rope on the rope drum 2. In an embodiment, the rope guiding device 1 may be adapted to guide the rope 9 also when the rope is wound on the rope drum 2 in two or more layers. In this case, the rope guiding device 1 may be used for both to compensate for the effect of the rope angle and to guide the rope on the rope drum 2 by means of the rope guiding force E formed by the actuator 4.

Figure 5:
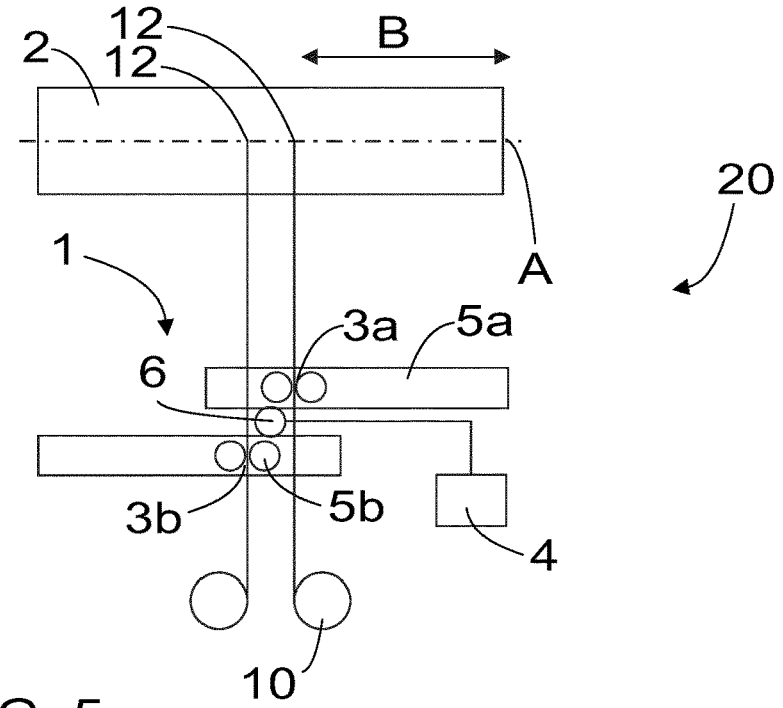
FIG. 5 is a schematic view of a hoisting device in its upper position.
Figure 6:
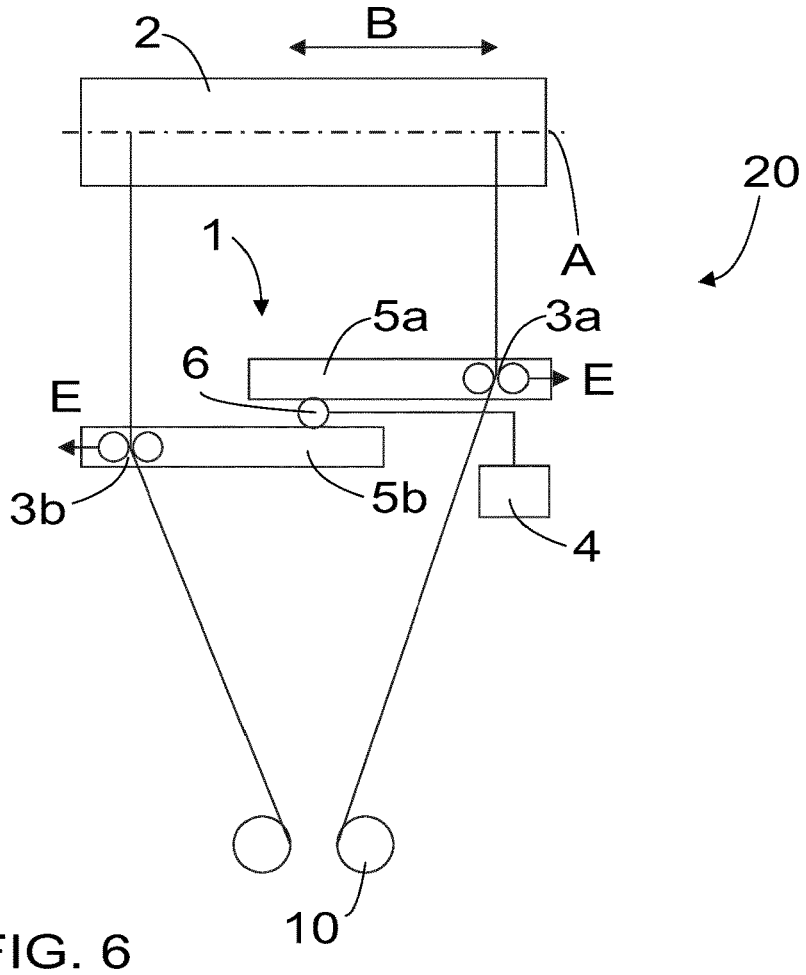
FIG. 6 is a schematic view of a hoisting device in its lower position.

FIG. 5 is a schematic view of a hoisting device 20 in its upper position and FIG. 6 is a schematic view of a hoisting device 20 in its lower position. Upper position in this context refers to the position of the hoisting device where the maximum amount of rope 9 is wound around the rope drum 2 and a load possibly adapted to the hoisting device is at its upmost position. Correspondingly, lower position in this context refers to the position of the hoisting device where the minimum amount of rope 9 is wound around the rope drum 2 and a load possibly adapted to the hoisting device is at its lowest position. In this case, the guiding structure 10 subsequently the closest to the rope drum 2 and guiding the direction of the rope, such as a rope pulley, is typically also at its upmost position. In an embodiment, the guiding structure 10 subsequently the closest to the rope drum 2 and guiding the direction of the rope may comprise a hoisting instrument such as a hook which may be adapted to the roping with rope pulleys.

The hoisting device 20 may comprise a rope guiding device 1 presented here to guide the hoisting rope 9 on the rope drum 2. The rope drum 2 may then be the rope drum of the hoisting device.

In an embodiment, the hoisting device 20 may comprise two ropes 9 adapted in the rope drum 2 so that the ropes 9 have been wound from the edges of the rope drum 2 towards the centre point D, more specifically the rope-covered part, of the rope drum. In such a case, at the upper position of the hoisting device 20, the run-off points 12 of the ropes from the rope drum are closest to each other, and correspondingly at the lowest position of the hoisting device, furthest away from each other in the direction B of the drum axis, as schematically shown in FIGS. 5 and 6, for example. It should be noted that for reasons of clarity FIGS. 4, 5, and 6 only show the rope 9 from the run-off point 12 of the rope towards the guiding structure 10 subsequently the closest to the rope drum 2 and guiding the direction of the rope, such as a rope pulley, and the rope portion wound on the rope drum 2, or the rope portion extending from the guiding structure 10 towards a load (not shown) are not shown.

In the embodiment of FIG. 4, there are two ropes 9 wound on a rope drum so that the left hand side rope has been wound from left to right and the right hand side rope from right to left, whereby the when the guiding structure 10 is at its upper position, both ropes are closest to the centre point D of the rope-covered area of the rope drum. In different embodiments, however, only one rope 9, or more than two ropes 9 may have been wound on the rope drum 2, and each rope 9 may have been would from left to right or right to left. FIGS. 14 to 17 illustrate some embodiments of the roping of the rope drum 2. The present solution is suitable for different kind of rope drum 2 ropings even though the invention is illustrated in FIGS. 1 to 6 with embodiments where two ropes 9 have been wound on the rope drum. In this case, in the solutions of FIGS. 1 to 3 and 5 to 6, for example, the rope guiding device 1 may comprise only on movement member 5*a* and one guiding element 3*a*. In other respects the solutions may correspond to the embodiments of two-rope ropings.

Figure 8:
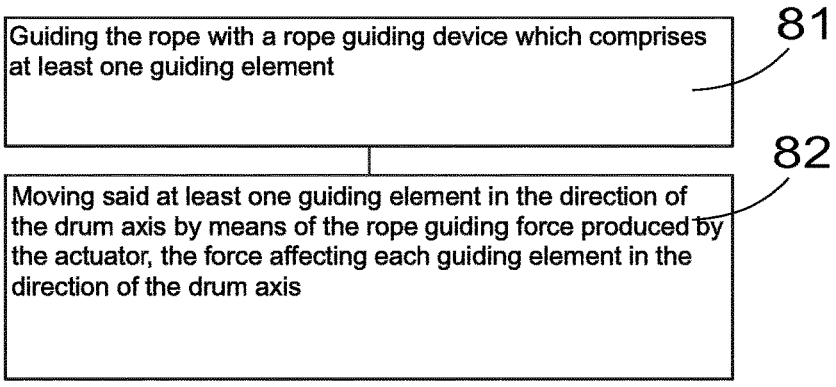
FIG. 8 shows schematically a method for guiding a rope.

FIG. 8 shows in schematic form a method for guiding a rope, to be more specific a method for guiding the rope 9 on the rope drum 2 by means of the rope guiding device 1. The rope drum 2 may be adapted to rotate about the drum axis A to wind the rope 9 around the rope drum or from the rope drum to hoist and lower a load (not shown) adapted on the rope. The method allows guiding 81 the rope with the rope guiding device 1 which comprises at least one guiding element 3*a*, 3*b*.

Further in the method, at least one guiding element 3*a*, 3*b* may be moved in the direction B of the drum axis by means of the rope guiding force E produced by the actuator 4, the force affecting each guiding element 3*a*, 3*b* in the direction B of the drum axis.

In an embodiment, the rope guiding device 1 may comprise at least two guiding elements 3*a*, 3*b*, or more than two guiding elements 3*a*. 3*b*. In such an embodiment, the guiding elements 3*a*, 3*b* may be moved in the direction B of the drum axis by means of the rope guiding force E produced by the actuator 4 at the same pace, so simultaneously, and at the same speed. Depending on the embodiment, the guiding elements 3*a*, 3*b* may in such a case be moved by the actuator 4 in opposite directions or mutually the same direction.

Figure 9:
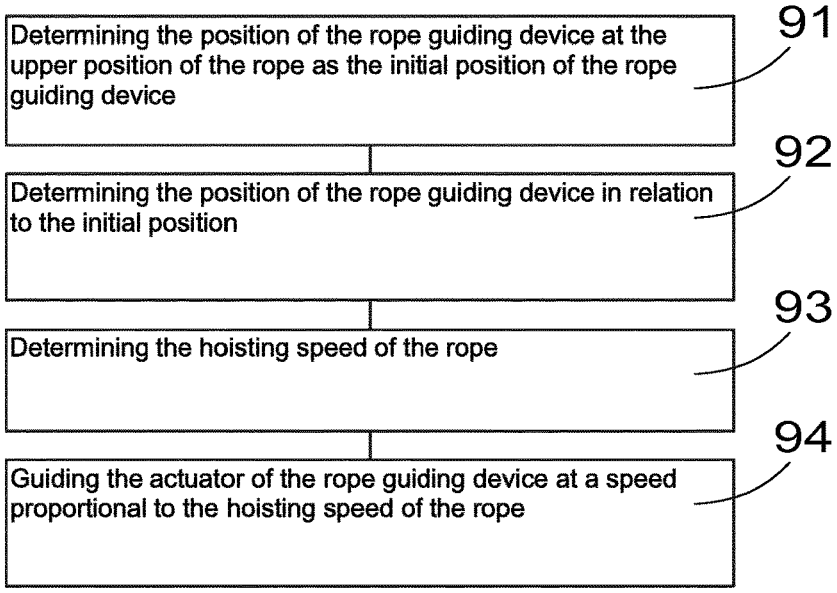
FIG. 9 shows schematically a method for guiding a rope guiding device.

FIG. 9 shows schematically a second method for guiding a rope guiding device 1. This method for guiding the rope guiding device 1 and correspondingly the methods described in connection with FIGS. 10 to 12 for guiding a rope guiding device 1 may advantageously be used each independently or as ac combination of two or more guiding methods in connection with the rope guiding method disclosed in connection with FIG. 8, in connection with a rope guiding device 1 or as such.

In the method of FIG. 9, the position of the rope guiding device 1 at the upper position of the rope is determined 91 as the initial position of the rope guiding device 1. Further in the method, the position of the rope guiding device 1 is determined 92 in relation to the initial position. Further still, the hoisting speed of the rope 9 is determined 93 in the method. In this case, the actuator 4 of the rope guiding device 1 may be guided 94 at a speed proportional to the hoisting speed of the rope 9 so that at any one time the mutual position of the rope 9 and the guiding element 3*a*, 3*b* of the rope guiding device 1, adapted to guide the rope 9 in question remains the same.

Figure 10:
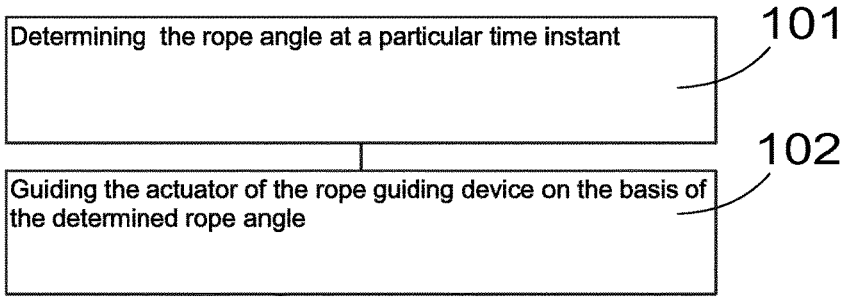
FIG. 10 shows schematically a second method for guiding a rope guiding device.

FIG. 10 shows schematically a second method for guiding a rope guiding device. In the method, the fleet angle C of the rope is determined 101 at a particular moment of time and the actuator of the rope guiding device is guided 102 on the basis of the determined rope fleet angle.

In an embodiment, the rope fleet angle C may be determined with a direct rope angle measurement. In such a case, the rope fleet angle C may be determined with an angle of deflection sensors or another sensor or method suitable to determine the rope fleet angle C.

In an embodiment, the rope fleet angle C may be so determined that the run-off point 12 of the rope from the rope drum 2 is determined, the position of the rope guiding device 1 is determined in relation to the rope drum 2, and the rope fleet angle C is determined on the basis of the rope run-off point and the position of the rope guiding device.

Figure 11:
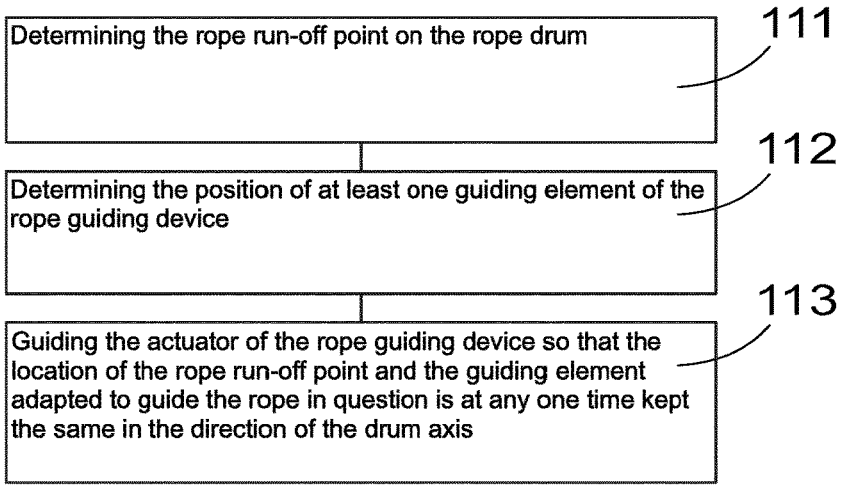
FIG. 11 shows schematically a third method for guiding a rope guiding device.

FIG. 11 shows schematically a third method for guiding a rope guiding device. In the method the rope run-off point 12 from the rope drum 2 is determined 111 and the position of at least one guiding element 3*a*. 3*b* of the rope guiding device is determined 112. Further in the method, the actuator 4 of the rope guiding device is so guided 113 that the position, in the direction B of the drum axis, of the rope run-off point 12 and the guiding element 3*a*, 3*b* adapted to guide said rope is kept the same at any one time.

In an embodiment, in connection with for example the rope guiding method shown in connection with FIG. 8, in connection with the guiding method of the rope guiding device shown in connection with FIGS. 9 to 11, or in connection with a rope guiding device 1 shown in this description, the actuator 4 of the rope guiding device is guided so that the rope fleet angle C from the rope drum remain substantially in the direction of the radius 11 of the rope drum.

Figure 12:
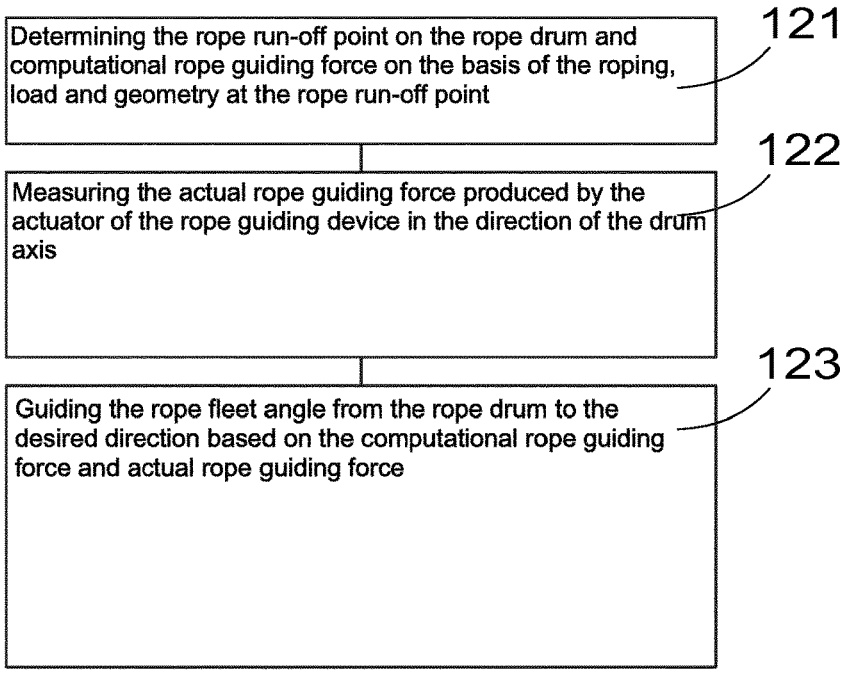
FIG. 12 shows schematically a fourth method for guiding a rope guiding device.

FIG. 12 shows schematically a fourth method for guiding a rope guiding device. In the method, a computational rope guiding force is calculated 121 on the basis of the roping, load and geometry at this rope run-off point 12 and the actual rope guiding force E produced by the actuator 4 of the rope guiding device in the direction of the drum axis is measured 122. Further in the method the fleet angle C of the rope from the rope drum is guided 123 to what is desired on the basis of the computational rope guiding force and the actual rope guiding force E, for example, substantially in the direction of the radius 11 of the rope drum.

Figure 13:
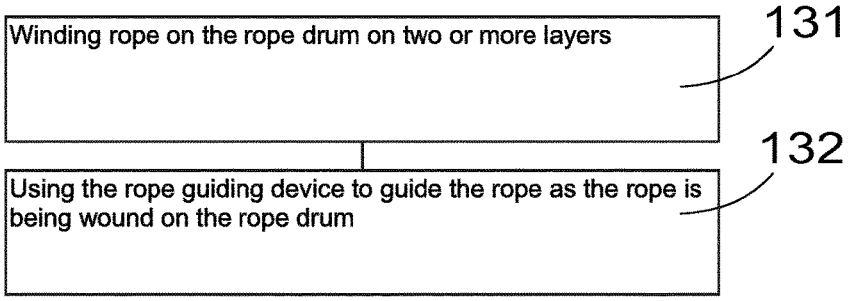
FIG. 13 shows schematically a method for guiding a rope.

In an embodiment, the rope 9 may be wound on the rope drum 2 and the rope guiding device 1 be used to guide the rope 9 when the rope is wound on the rope drum 2. FIG. 13 is a schematic view of a method for guiding a rope, in which method the rope 9 is wound 131 on the rope drum 2 in two or more layers and the rope guiding device 1 is used 132 to guide the rope 9 when the rope is wound on the rope drum 2.

In FIGS. 1 to 6 the features of the invention are illustrated in connection with an embodiment where two ropes 9 are adapted on the rope drum 2 so that the ropes 9 have been wound from the edges of the rope drum 2 towards the centre point D, more specifically the rope-covered part, of the rope drum. In such a case, at the upper position of the hoisting device 20, the run-off points 12 of the ropes from the rope drum are closest to each other, and correspondingly at the lowest position of the hoisting device, furthest away from each other in the direction B of the drum axis A, as schematically shown in FIGS. 5 and 6, for example. The rope guiding device 1, hoisting device 20 and method are, however, also suitable for other types of ropings of the rope drum 2, such as grooves. FIGS. 14 to 17 show exemplary ropings of the rope drum for which the present solution is suitable. However, the solution is suitable for other ropings of the rope drum 2, for example in some embodiments the hoisting device 20 may comprise a plurality of rope drums 2 and/or on each rope drum 2 more than two ropes 9 may also be wound.

Figure 14:
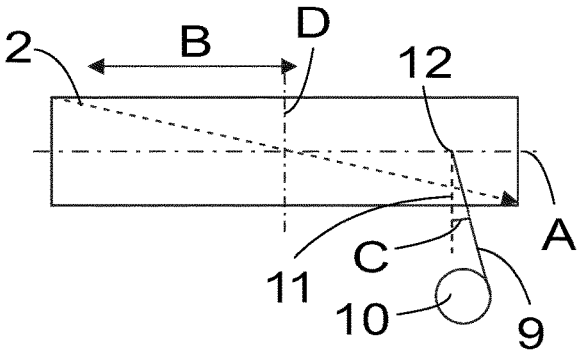
FIGS. 14 to 17 show different embodiments of the roping of a rope drum.
Figure 15:
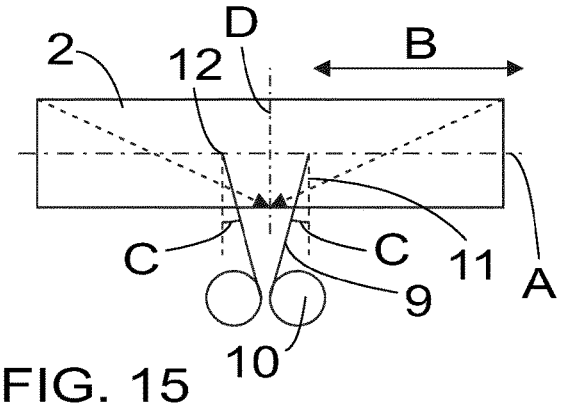

In the embodiment of FIG. 14, there is one roped 9 adapted on the rope drum 2. In the embodiment of FIG. 9, the rope in question is wound left to right whereby the rope run-off point 12 from the rope drum is closest to the right edge of the rope drum 2 when the guiding structure 10 is at the upper position, but naturally the rope 9 could equally well be wound from right to left. The winding directions are shown with dotted line arrows in FIGS. 14 to 17. FIG. 15 corresponds to FIG. 4, where there are two ropes 9 adapted on the rope drum 2, the left rope of which is wound left to right and the right rope from right to left, whereby the rope run-off points 12 from the rope drum are closest to each other and closest to the rope-covered centre point D of the rope drum as the guiding structure 10 is at its upmost position.

Figure 16:
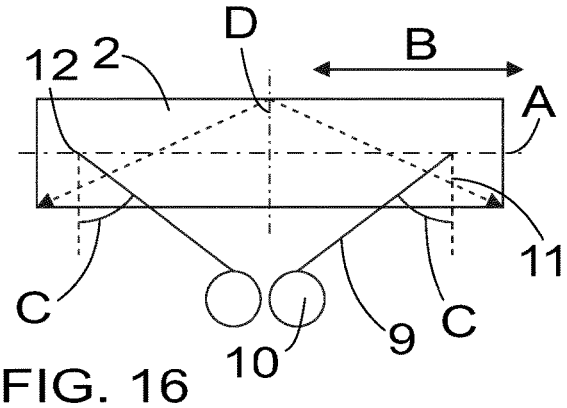

In the embodiment of FIG. 16, two ropes 9 may have been adapted on the rope drum 2 so that they have been so wound that the left rope is wound right to left and the right rope from left to right, whereby the rope run-off points 12 from the rope drum are furthest from each other and furthest from the rope-covered centre point D of the rope drum as the guiding structure 10 is at its upmost position. In other words, the ropes 9 have been wound from the centre point D towards the edges of the rope drum 2 whereby at the upper position of the hoisting device 20 the rope run-off points 12 from the rope drum are furthest from each other and correspondingly at the lowest position of the hoisting device closest to each other in the direction B of the drum axis A.

Figure 17:
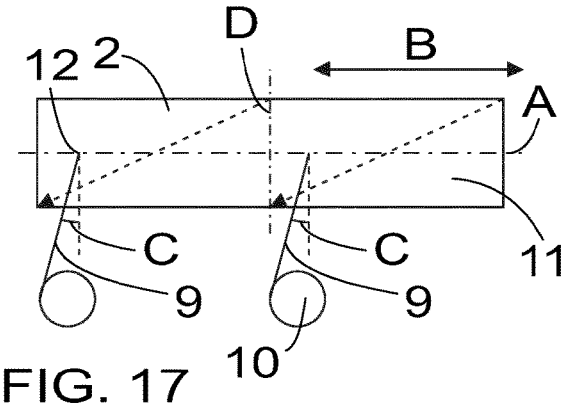

In the embodiments of FIGS. 15 and 16, the guiding elements 3*a*, 3*b* meant to guide each rope 9 may adapted to travel in mutually different directions by means of, for example, the rope guiding force conveyed by movement members 5*a*, 5*b*. In the embodiment of FIG. 17, there are also two ropes 9 adapted on the roped drum, but they have both been wound in the same direction.

In the embodiment of FIG. 17, both ropes have been wound from right to left but equally well they may be wound from left to rights. In such a case the rope run-off point 12 from the rope drum remain at an equal distance from each other irrespective of the whether the guiding structure 10 is at its upmost or lowest position or between them. In other words, the ropes 9 are in such a case wound in mutually the same direction whereby the rope run-off points 12 from the rope drum are at an equal distance from each other in all the positions of the hoisting device. In such a case the guiding elements 3*a*, 3*b* intended to guide each rope may be adapted to travel mutually in the same direction by means of the rope guiding force conveyed by the movement members 5*a*, 5*b*, such as the toothed bar, screw, belt or another movement member. Such embodiments may be implemented by adapting two or more guiding elements 3*a*, 3*b* in the same movement member 5*a*, 5*b*.

In yet another embodiment the roping of each rope drum 2 may comprise a combination of such ropings. It is obvious for a person skilled in the art that in other respects the solutions may correspond with, when applicable, the embodiments presented elsewhere in this description and the related drawings, or combinations thereof.

It should be noted that for reasons of clarity FIGS. 14-17 only show the rope 9 from the run-off point 12 of the rope towards the guiding structure 10 subsequently the closest to the rope drum 2 and guiding the direction of the rope, such as a rope pulley, and the rope portion wound on the rope drum 2, or the rope portion extending from the guiding structure 10 towards a load (not shown) are not shown. In other respects, too, the Figures are only intended to illustrate and underline the features of the solution, and the scale or the dimensions of the rope fleet angles C do not correspond with actual conditions.

In an embodiment the rope 9 may be guided on the rope drum 2 with a rope guiding device 1 described in this document.

A person skilled in the art will find it obvious that, as technology advances, the basic idea of the invention may be implemented in many different ways. The invention and its embodiments are thus not restricted to the above-described examples but may vary within the scope of the claims.

The invention claimed is:

1. A rope guiding device for guiding a rope on a rope drum, the rope drum being adaptable to rotate about a drum axis to wind the rope around the rope drum or from the rope drum to hoist and lower a load adapted on the rope, the rope guiding device comprising:

at least one guiding element;

an actuator for generating a rope guiding force in the direction of the drum axis; and at least one movement member adapted to convey the force generated by the actuator to the at least one guiding element in the direction of the drum axis so that the movement of each of the at least one guiding element in the direction of the drum axis may be guided by the force, whereby the rope guiding device is arranged to compensate a rope angle which is caused by the angle between a rope run-off point from the rope drum and a subsequent guiding structure closest to the rope drum and guiding the direction of the rope, by the force parallel to the drum axis of the rope drum, and wherein said actuator is adapted to guide each guiding element to such a position that the fleet angle of the rope from the rope drum is less than 4 degrees in relation to direction of a radius of the rope drum, regardless of the angle between rope run-off point from the rope drum and the subsequent guiding structure closest to the rope drum and guiding the direction of the rope.

2. The rope guiding device as claimed in claim 1, wherein said rope fleet angle from the rope drum is substantially in the direction of the radius of the rope drum.

3. The rope guiding device as claimed in claim 1, wherein the rope guiding device comprises at least two of the at least one guiding element and said at least two guiding elements are adapted to move mutually at the same pace in at least the direction of the rope drum.

4. The rope guiding device as claimed in claim 3, comprising:

a first of the at least one movement member extending in the direction of the drum axis, to which a first of said at least two guiding elements is immovably adapted; and a second of the at least one movement member extending in the direction of the drum axis, to which a second of said at least two guiding elements is immovably adapted, whereby the first movement member and the second movement member are coupled to each other so that the actuator simultaneously acts on the first movement member and the second movement member, wherein the first movement member is adapted to convey the rope guiding force created by the actuator to the first guiding element, and wherein the second movement member is adapted to convey the rope guiding force created by the actuator to the second guiding element.

5. The rope guiding device as claimed in claim 4, wherein the first movement member comprises a first toothed bar and the second movement member comprises a second toothed bar which are intercoupled by a geared axle, the toothing of the geared axle being adapted to couple to the toothing on both the first toothed bar and the second toothed bar so that the toothed bars move, as the geared axle is rotated, simultaneously to opposite directions in the direction of the drum axis, and wherein the actuator is adapted to rotate the geared axle.

6. The rope guiding device as claimed in claim 4, wherein the first movement member comprises a right-handed screw and the second movement member comprises a left-handed screw, and wherein said right-handed screw and left-handed screw are connected to each other at their ends, and the actuator is adapted to rotate the interconnected screws so that the at least two guiding elements adapted in said screws move, as the screws are rotated, simultaneously to opposite directions in the direction of the drum axis.

7. The rope guiding device as claimed in claim 4, wherein the actuator is adapted to rotate a drive wheel, and wherein the first movement member and second movement member form a belt so that the first guiding element and the second guiding element are adapted on different sides of the drive wheel, whereby the actuator is adapted to rotate the belt by the drive wheel so that the first guiding element and the second guiding element move simultaneously in different directions in the direction of the drum axis.

8. The rope guiding device as claimed in claim 1, comprising:

the at least one movement member extending in the direction of the drum axis, to which the at least one guiding element is immovably adapted, whereby the actuator affects each of the at least one movement member and each of the at least one movement member is at any one time adapted to convey the rope guiding force generated by the actuator to said at least one guiding element adapted in said at least one movement member.

9. The rope guiding device as claimed in claim 1, wherein the actuator comprises a gear motor or rope drum.

10. The rope guiding device as claimed in claim 1 wherein the rope guiding device is adapted to guide the rope also when the rope is being wound on the rope drum in two or more layers.

11. A hoisting device which comprises the rope guiding device as claimed in claim 1 for guiding a hoisting rope on the rope drum which is the rope drum of the hoisting device.

12. The hoisting device as claimed in claim 11 and comprising two ropes adapted on the rope drum in one of the following ways:

such that the ropes are wound from the edges of the rope drum towards the centre point of the rope drum, whereby, at the upper position of the hoisting device, the run-off points of the ropes from the rope drum are closest to each other, and correspondingly at the lowest position of the hoisting device, furthest away from each other in the direction of the drum axis, such that the ropes are wound from the centre point of the rope drum towards the edges of the rope drum whereby at the upper position of the hoisting device the rope run-off points from the rope drum are furthest from each other and correspondingly at the lowest position of the hoisting device closest to each other in the direction of the drum axis, or such that the ropes are wound in mutually the same direction whereby the rope run-off points from the rope drum are at an equal distance from each other in all the positions of the hoisting device.

13. A hoisting device which comprises a rope guiding device for guiding a hoisting rope on a rope drum, the rope drum being adaptable to rotate about a drum axis to wind the rope around the rope drum or from the rope drum to hoist and lower a load adapted on the rope, the rope guiding device comprising:

at least one guiding element;

an actuator for generating a rope guiding force in the direction of the drum axis; and at least one movement member adapted to convey the force generated by the actuator to the at least one guiding element in the direction of the drum axis so that the movement of each of the at least one guiding element in the direction of the drum axis may be guided by the force, whereby the rope guiding device is arranged to compensate a rope angle which is caused by the angle between a rope run-off point from the rope drum and a subsequent guiding structure closest to the rope drum and guiding the direction of the rope, by the force parallel to the drum axis of the rope drum, and wherein the hoisting device comprises two ropes adapted on the rope drum in one of the following ways:

such that the ropes are wound from the edges of the rope drum towards the centre point of the rope drum, whereby, at the upper position of the hoisting device, the run-off points of the ropes from the rope drum are closest to each other, and correspondingly at the lowest position of the hoisting device, furthest away from each other in the direction of the drum axis, such that the ropes are wound from the centre point of the rope drum towards the edges of the rope drum whereby at the upper position of the hoisting device the rope run-off points from the rope drum are furthest from each other and correspondingly at the lowest position of the hoisting device closest to each other in the direction of the drum axis, or such that the ropes are wound in mutually the same direction whereby the rope run-off points from the rope drum are at an equal distance from each other in all the positions of the hoisting device.

* * * * *